US008230666B2

(12) United States Patent
Strauss et al.

(10) Patent No.: US 8,230,666 B2
(45) Date of Patent: Jul. 31, 2012

(54) LOCKING HEADPLATE FOR ADJUSTABLE SADDLE TREE

(75) Inventors: Isidore Strauss, Bridgewater, NJ (US); Lynnda Scears, Galesburg, MI (US)

(73) Assignee: Intec Corporation, Cliffwood, NJ (US)

( * ) Notice: Subject to any disclaimer, the term of this patent is extended or adjusted under 35 U.S.C. 154(b) by 146 days.

(21) Appl. No.: 12/639,585

(22) Filed: Dec. 16, 2009

(65) Prior Publication Data

US 2010/0229507 A1 Sep. 16, 2010

Related U.S. Application Data

(60) Provisional application No. 61/160,436, filed on Mar. 16, 2009.

(51) Int. Cl.
*B68C 1/04* (2006.01)

(52) U.S. Cl. ..... 54/44.3

(58) Field of Classification Search ..... 54/44.1, 54/44.3, 44.5, 40.1, 42.1, 47
See application file for complete search history.

(56) References Cited

U.S. PATENT DOCUMENTS

| | | | | |
|---|---|---|---|---|
| 11,068 | A | 6/1854 | Jones | |
| 121 | A | 4/1855 | Jones | |
| 38,404 | A | 5/1863 | Nichols | |
| 79,953 | A | 7/1868 | Cline | |
| 151,976 | A | 6/1874 | Heaton et al. | |
| 320,522 | A | 6/1885 | Wint | |
| 821,135 | A | 5/1906 | Szameitat | |
| 1,246,675 | A | 11/1917 | Stewart | |
| 1,321,398 | A | 11/1919 | Sievert | |
| 4,996,827 | A | 3/1991 | Pellew | |
| 5,383,328 | A | 1/1995 | Brown | |
| 5,884,459 | A | 3/1999 | Biddlecome | |
| 6,523,332 | B1 | 2/2003 | Erb | |
| 6,920,743 | B2 | 7/2005 | Harrison | |
| 7,178,318 | B2 | 2/2007 | Swain | |
| 7,360,349 | B2 | 4/2008 | Walker | |
| 2008/0104934 | A1 * | 5/2008 | Morin | 54/49 |

FOREIGN PATENT DOCUMENTS

| | | |
|---|---|---|
| DE | 73622 | 6/1893 |
| DE | 2923002 | 12/1980 |
| EP | 0 328 376 | 8/1989 |
| EP | 1647521 | 4/2006 |
| GB | 2254234 | 10/1992 |

OTHER PUBLICATIONS

EP 10 27 5113 European Search Report Mar. 28, 2011.

* cited by examiner

*Primary Examiner* — Son T Nguyen
(74) *Attorney, Agent, or Firm* — King & Schickli, PLLC

(57) ABSTRACT

A locking headplate for an adjustable saddle tree includes opposed, hingedly connected elements for securing to a saddle tree head portion, a rotatable displacing element for displacing the hingedly connected plates inwardly or outwardly, and an engaging element for selectively preventing rotation of the rotatable displacing element. The engaging element includes at least one insert and a threaded fastener for compressing the insert against the rotatable displacing element to selectively prevent rotation thereof. A portion of the rotatable displacing element may be made of a material having a first hardness, and the insert may be made of a material having a second hardness which is less than the first hardness whereby a portion of the rotatable displacing element impinges into the material of the insert. Saddle trees and saddles incorporating the locking headplate are provided.

19 Claims, 9 Drawing Sheets

LOCKING HEADPLATE FOR ADJUSTABLE SADDLE TREE

This application claims the benefit of priority of U.S. Provisional patent application Ser. No. 61/160,436, filed on Mar. 16, 2009, the disclosure of which is incorporated in its entirety herein by reference.

TECHNICAL FIELD

The present invention relates to saddle trees for saddles used in equitation. In particular, the invention relates to a locking headplate for a saddle tree, and to saddle trees and saddles incorporating the locking headplate for providing a custom-like fit of a saddle.

BACKGROUND OF THE INVENTION

Modern equestrian saddles possess various common elements, including a seat portion on which a rider sits, a pommel, a cantle, and side flaps. Underpinning these structures is the saddle tree, known to be a base on which the remainder of the saddle is built. The saddle tree typically includes a body defining a frame for the saddle, and including a head portion, two side portions, and a cantle or end portion. Among other functions, the saddle tree determines the width of a saddle. A conventional saddle tree is manufactured of wood or a suitable synthetic material, and eventually is provided with one or more layers of padding and covered in leather or a suitable leather-like synthetic material to define the saddle. It is an important part of saddle making and saddle fitting to properly match the saddle width, determined by the saddle tree width, to the back of the horse which will be wearing the saddle. An improperly fitted saddle may result in discomfort and potential injury to the horse's back.

Indeed, saddle width is the primary criteria by which a saddle is measured and fitted to a horse, although of course length of tree and proper balance must also be considered. The saddle must clear the withers of the horse, but yet must not be so narrow as to pinch the horse's back. The tree must be positioned to prevent interfering with the movement of the horse's shoulder. The seat of the saddle must be positioned so that the rider, when riding correctly, is placed over the horse's center of balance. Saddle blankets or pads can assist in correcting minor fit problems, but no amount of padding can compensate for a poorly-fitted saddle.

Conventional saddles typically include a non-adjustable saddle tree, and for that reason a particular saddle may only fit a narrow range of horses. That is, a saddle which comfortably fits one particular horse may not fit other, larger or smaller horses, or even horses of substantially the same size but having differently-shaped backs.

Even more, the same saddle may not fit even the same horse for an extended period of time without adjustments. As a horse advances in conditioning, age, and training, the back muscles and even the underlying skeletal structures change to some degree. Thus, particularly with English saddles, periodic adjustments to the saddle may be necessary. In some cases, a horse will physically develop to a degree that a different saddle may have to be purchased.

Still further, an individual rider may ride a number of horses, each having a differently sized and shaped back, over the course of a riding career or even concurrently in the case of a professional rider or an upper-level amateur rider. With a conventional, non-adjustable saddle tree, this requires that the rider return a saddle to a professional saddle fitter for adjustment, or alternatively be able to purchase or otherwise access a number of saddles of differing widths. Either option increases the expense incurred by that rider. However, failing to properly fit the saddle to a horse risks injury to the horse.

Seeking a compromise between cost and safety, attempts have been made in the art to provide saddles having adjustable saddle trees, to allow incrementally widening or narrowing the saddle tree (and the width of the saddle incorporating the tree) to comfortably fit a range of horses. One such adjustable saddle tree is described in U.S. Pat. No. 4,996,827 to Pellew, which teaches a saddle tree comprising plate members configured for pivotal movement, and an adjusting mechanism for accomplishing such pivotal movement.

Such devices are suitable for their intended purpose, that is, adjusting the position of opposed elements of a saddle tree relative to one another to allow saddle width adjustment. However, improvements in such devices are desirable. For example, it is known in the fastener arts that vibration and temperature extremes may cause loosening of threaded elements such as those describe for the adjusting mechanism described in the '827 patent. Further, in conventional saddles incorporating an adjustable saddle tree, the opposed side panels of the saddle tree may remain relatively fixed in place relative to one another only when the weight of a rider is fully on a saddle seat incorporating it.

On the other hand, when the rider's weight is not fully on the saddle seat, movement of the opposed side panels relative to one another may occur. For example, during such activities as posting, jumping, galloping over uneven terrain, and the like a rider frequently adopts a "two-point" stance, that is, feet in the stirrups but with no contact between rider and saddle seat. At such times, the opposed side panels of a conventional adjustable saddle tree may move or displace relative to one another. This movement or flexing is at the least distracting, and may potentially be injurious to both horse and rider. For this reason, there remains a need in the art for improvements in adjustable saddles/saddle trees.

SUMMARY OF THE INVENTION

The above-mentioned and other problems become solved by applying the principles and teachings associated with the hereinafter-described devices for providing adjustable saddles and saddle trees. Broadly, the present disclosure provides devices for providing incremental adjustability to a saddle tree, and to a saddle incorporating it, allowing widening or narrowing such a saddle tree and/or saddle in accordance with the dimensions of the back of an animal on which the saddle will be placed.

In one aspect, a locking headplate for an adjustable saddle tree is provided, including opposed and hingedly connected elements for securing to a saddle tree head portion. The locking headplate further includes a rotatable displacing element for displacing the hingedly connected plates inwardly or outwardly, and an engaging element for selectively preventing rotation of the rotatable displacing element.

In one embodiment, the engaging element includes at least one insert and a threaded fastener for compressing the at least one insert against the rotatable displacing element to selectively prevent rotation thereof. In embodiments wherein the rotatable displacing element includes a screwthreaded pin, the threaded fastener compresses the at least one insert against a screwthreaded pin of the rotatable displacing element to prevent rotation thereof.

In yet another embodiment, at least a screwthread of the screwthreaded pin of the rotatable displacing element may be made of a material having a first hardness. The at least one insert may be made of a material having a second hardness which is less than the first hardness. Accordingly, when the threaded fastener compresses the at least one insert against the screwthreaded pin of the rotatable displacing element, a portion of the material of the screwthread of the screwthreaded pin impinges into the material of the insert. It will be appreciated that this feature improves the contact of the insert and the rotatable displacing element, further improving the efficacy of the described mechanism.

In other aspects, adjustable saddle trees incorporating the locking headplate according to the foregoing description are provided. In still yet other aspects, adjustable saddles incorporating adjustable saddle trees according to the foregoing description are provided.

These and other embodiments, aspects, advantages, and features of the present invention will be set forth in the description which follows, and in part will become apparent to those of ordinary skill in the art by reference to the following description of the invention and referenced drawings or by practice of the invention. The aspects, advantages, and features of the invention are realized and attained by means of the instrumentalities, procedures, and combinations particularly pointed out in the appended claims.

BRIEF DESCRIPTION OF THE DRAWING

The accompanying drawings incorporated in and forming a part of the specification, illustrate several aspects of the present invention, and together with the description serve to explain the principles of the invention. In the drawings.

DETAILED DESCRIPTION OF THE INVENTION

Figure 1:
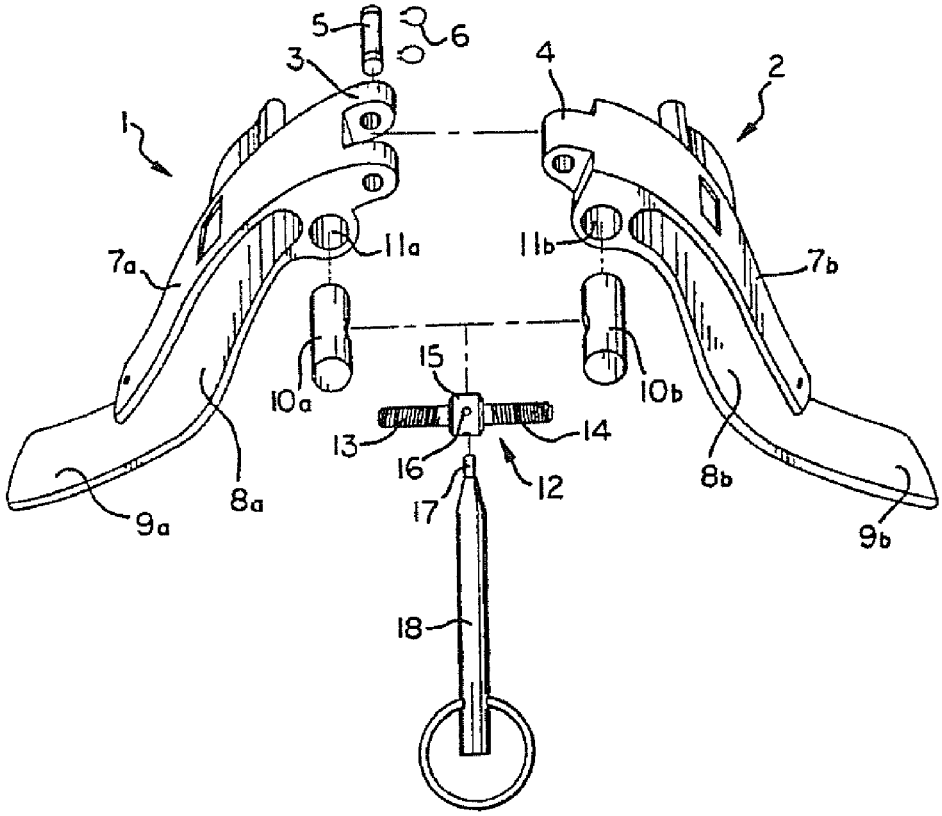
Fig. 1 (Prior Art)
FIG. 1 shows a prior art adjustable saddle tree headplate.

With reference to the appended drawing figures, FIG. 1 shows a prior art adjustable saddle tree as set forth in U.S. Pat. No. 4,996,827 (the '827 patent) to Pellew. The device according to the '827 patent includes first and second plate members 1, 2, configured to be hingedly connected by a hinge pin 5. Plate members 1, 2 include apertures 11*a*, 11*b* for rotatably receiving barrels 10*a*, 10*b* therein. Each of barrels 10*a*, 10*b* of the '827 patent include threaded apertures for receiving screwthread pin 12 therein.

Screwthreaded pin 12 includes opposingly threaded screwthreads 13, 14. Thus, rotating screwthreaded pin 12 clockwise will move plate members 1, 2 relative to one another in a first direction, and rotating pin 12 counter-clockwise will move plate members 1, 2 in the opposite direction, narrowing or widening the plate members 1, 2 and correspondingly narrowing or widening a saddle tree secured thereto as needed.

This mechanism accordingly relies nearly exclusively on screwthreaded pin 12 both to adjust plate members 1, 2 relative to one another, and also to prevent displacement of plate members 1, 2 relative to one another after such adjustment. In addition, the weight of a rider seated on a saddle during use will "capture" the saddle and plate members 1, 2 between the rider and the horse, further reducing displacement or flexing of plate members 1, 2 relative to one another. As long as the rider's weight remains in the saddle seat, the plate members 1, 2 will not displace relative to one another.

Without the weight of a rider disposed upon a saddle seat incorporating the plate members of the '827 patent, only screwthreaded pin 12 prevents such displacement of plate members 1, 2. It is known in the fastening arts that vibration and extremes of temperature may cause spontaneous loosening of threaded element such as screwthreaded pin 12 of the '827 patent. Thus, when a rider is in a two point stance, that is, when the rider's weight is supported substantially exclusively by the stirrups rather than the saddle seat, during use such as jumping, galloping, or the like, screwthreaded pin 12 may rotate and the plate members 1, 2 may undesirably be displaced relative to one another, altering the width of the saddle tree during use.

Figure 2:
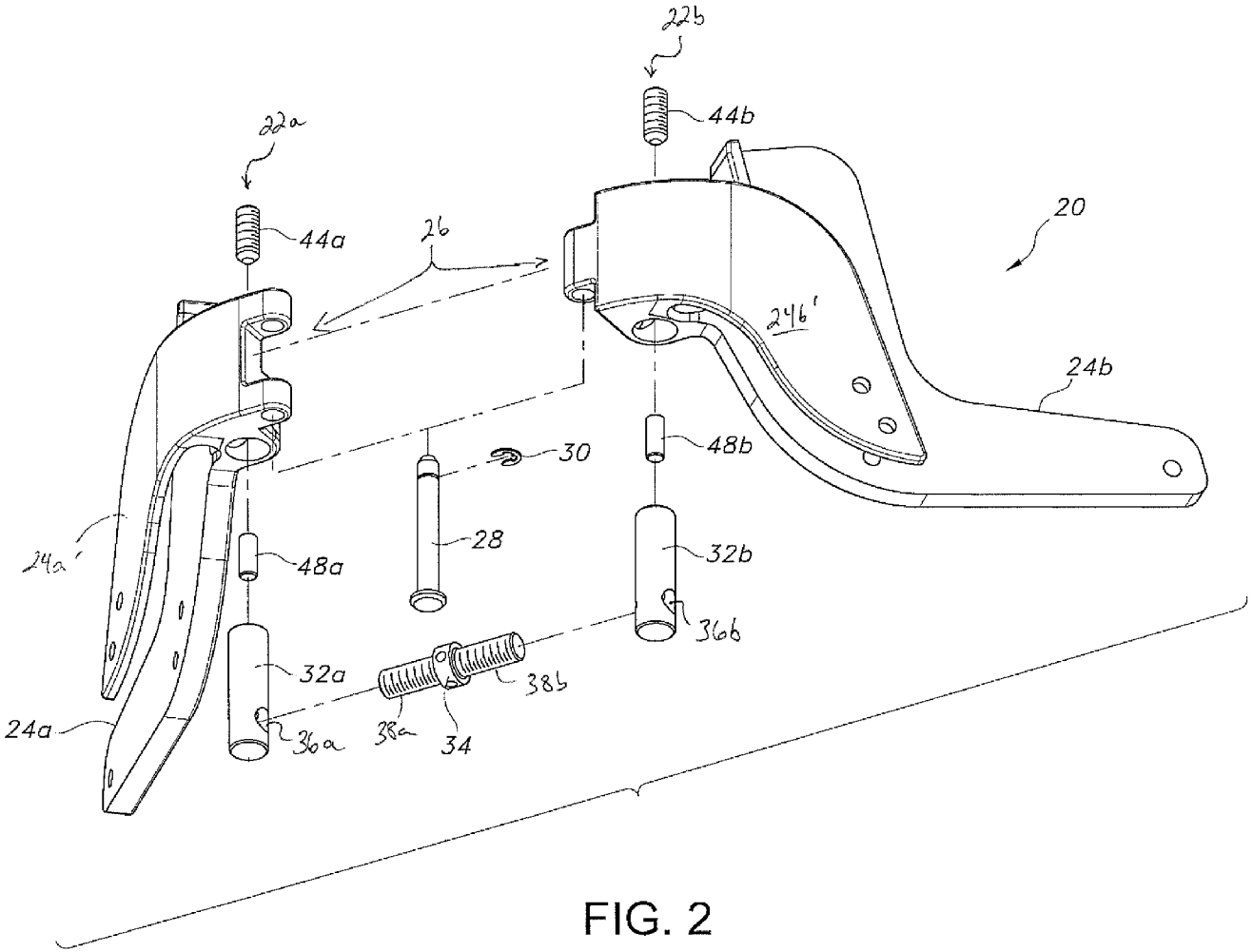
FIG. 2 shows a locking headplate assembly for an adjustable saddle tree according to the present invention in exploded top plan view.
Figure 3:
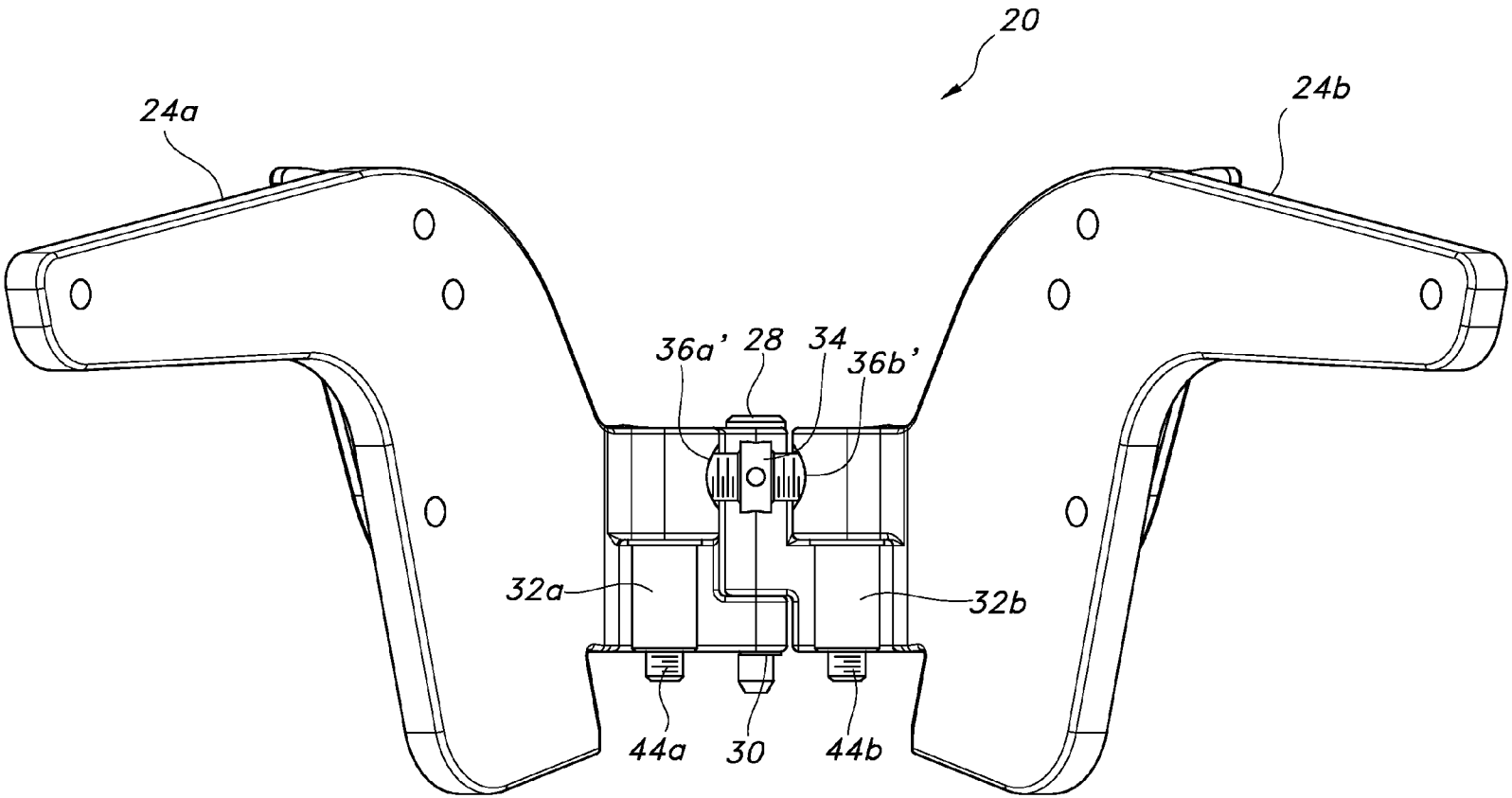
FIG. 3 shows the locking headplate assembly of FIG. 2 in bottom plan view.
Figure 4:
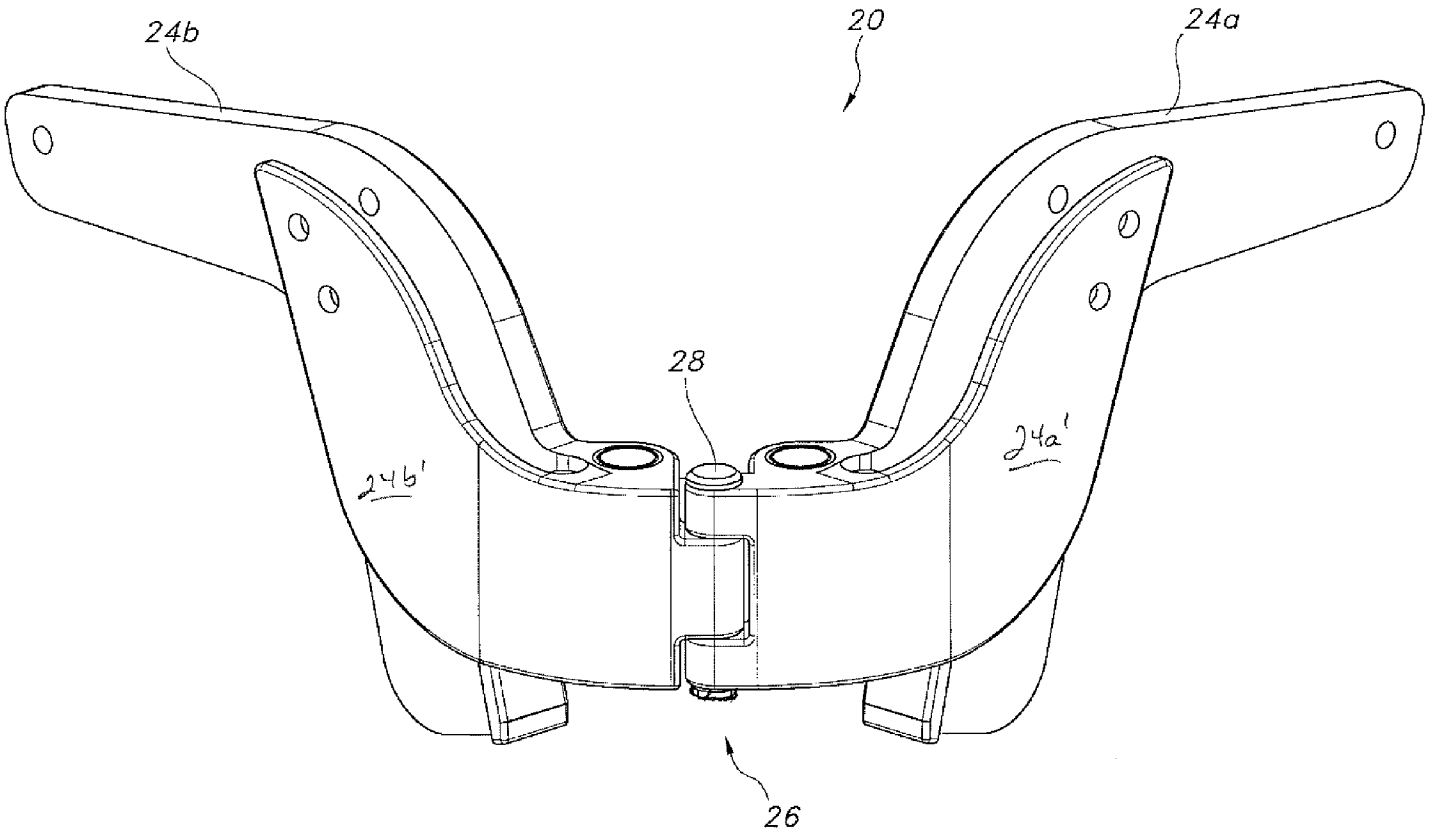
FIG. 4 shows the locking headplate assembly of FIG. 2 in top plan view.

The aforementioned problem is solved by the presently disclosed locking headplate 20 (see FIG. 2), wherein is provided a locking mechanism 22*a*, 22*b* for preventing movement or flexing of opposed sides of the saddle tree 20. With reference to FIGS. 2-4, the locking headplate 20 includes opposed side plates 24*a*, 24*a*', 24*b*, 24*b*', hingedly connected by a hinge structure 26, secured in place by a pin 28. Additional retainers 30 may be provided, such as C-clips, pins, clips, or the like, for preventing withdrawal of pin 28 and separation of hinge structure 26. Alternatively, pin 28 may simply include an enlarged head, such as a rivet-type head, at opposed ends thereof to prevent withdrawal of pin 28 and separation of hinge structure 26 (see FIG. 4).

Figure 5:
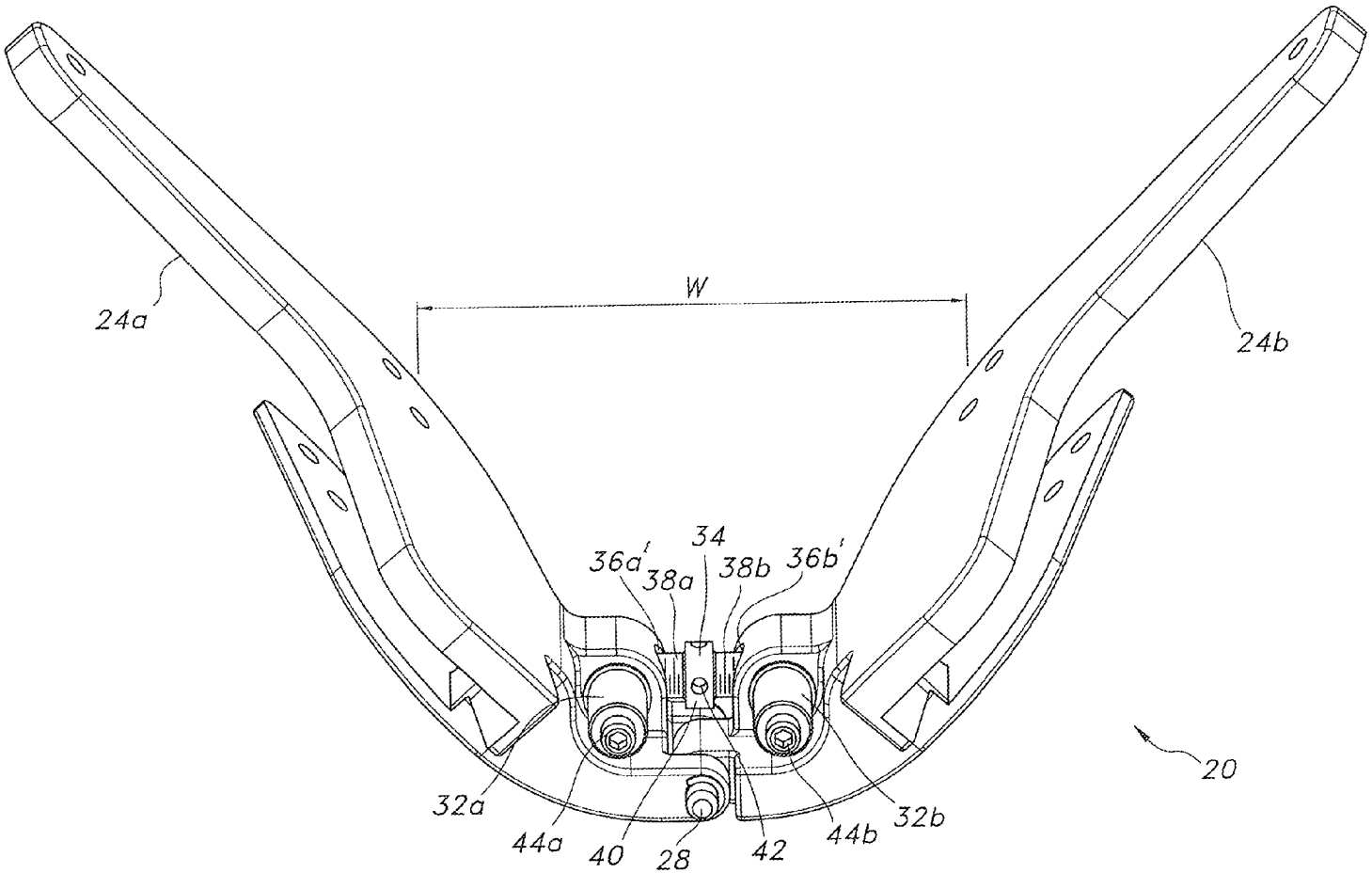
FIG. 5 shows an end view of the locking headplate assembly of FIG. 2.

Opposed side plates 24*a*, 24*a*', 24*b*, 24*b*' each include an aperture for rotatably receiving an adjusting cylinder 32*a*, 32*b*. Each adjusting cylinder 32*a*, 32*b* defines a first threaded receiver 36*a*, 36*b* for receiving a threaded adjuster 34 therein. Each of side plates 24*a*, 24*a*', 24*b*, 24*b*' include an aperture 36*a*', 36*b*' (best seen in FIGS. 3 and 5 which, when the saddle tree 20 is assembled, substantially align with the threaded receivers 36*a*, 36*b* in adjusting cylinders 32*a*, 32*b*. As shown in FIG. 5, adjuster 34 includes opposed, oppositely threaded pins 38*a*, 38*b* and a central hub 40 with at least one adjusting aperture 42 therein, wherein threaded pins 38*a*, 38*b* are received in correspondingly threaded apertures 36*a*, 36*b*. The foregoing mechanism is shown assembled in FIGS. 3-4. In an embodiment, apertures 36*a*', 36*b* ' define a cross-sectional dimension that is greater than a cross-sectional dimension of threaded receivers 36*a*, 36*b* and of threaded pins 38*a*, 38*b*. As will be appreciated, this provides an increased range of motion for displacing opposed side plates 24*a*, 24*a*', 24*b*, 24*b*'.

Figure 6:
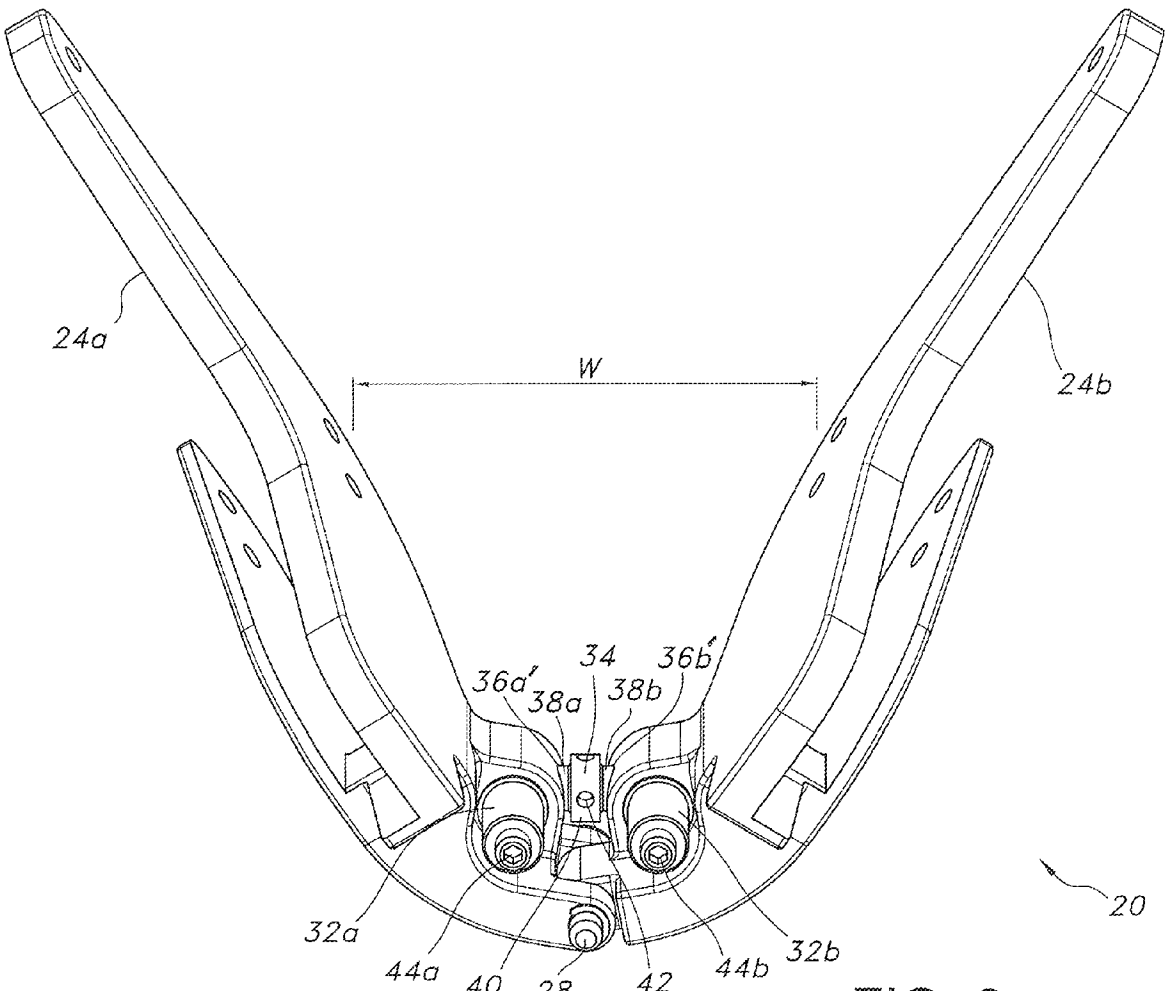
FIG. 6 shows the end view of FIG. 5, demonstrating a decrease in width of the locking headplate assembly.

As the skilled artisan will appreciate, rotating adjuster 34 in a first direction via central hub 40 will cause the oppositely threaded pins 38*a*, 38*b* to displace the opposed side plates 24*a*, 24*a*', 24*b*, 24*b*' in a first direction. Rotating adjuster 34 in a second direction that is directly opposed to the first direction via central hub 40 will cause the oppositely threaded pins 38*a*, 38*b* to displace the opposed side plates 24*a*, 24*a*', 24*b*, 24*b*' in a second direction that is directly opposed to the first direction. Thus, as an example, depending on the threading directions of pins 38*a*, 38*b*, turning central hub 40 in a clockwise direction may increase the width W of the locking headplate 20, whereas turning central hub 40 in a counter-clockwise direction may decrease the width W of the locking headplate 20. This is shown in FIGS. 5 and 6. Thus, the user, by incrementally adjusting the saddle tree width W as described, can customize the fit of a saddle incorporating locking headplate 20 as desired.

Structures for preventing further movement of opposed side plates 24*a*, 24*a*', 24*b*, 24*b*' once the user has adjusted the locking headplate 20 to a desired width W will now be described, with reference to FIGS. 2, 7, and 8. As shown in those drawing figures, each adjusting cylinder 32*a*, 32*b* defines a second threaded receiver 44*a*, 44*b* for receiving a correspondingly threaded locking fastener 44*a*, 44*b* therein. In the depicted embodiment, locking fasteners 44*a*, 44*b* are socket head screws which may be tightened and loosened by use of a conventional hex key wrench.

Figure 7:
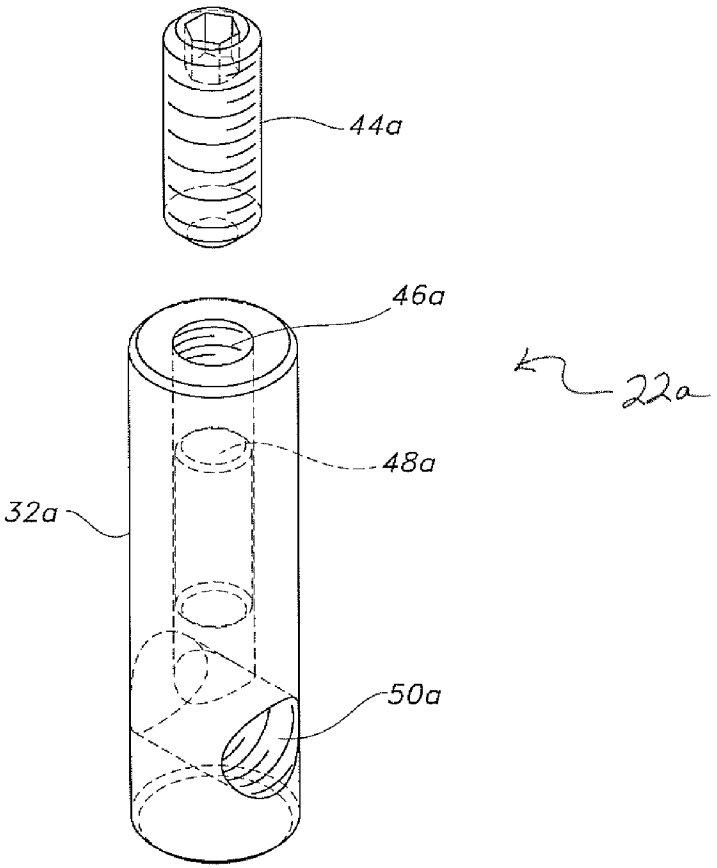
FIG. 7 shows an exploded side cross-sectional view of a locking mechanism for the locking headplate assembly according to the present invention.
Figure 8:
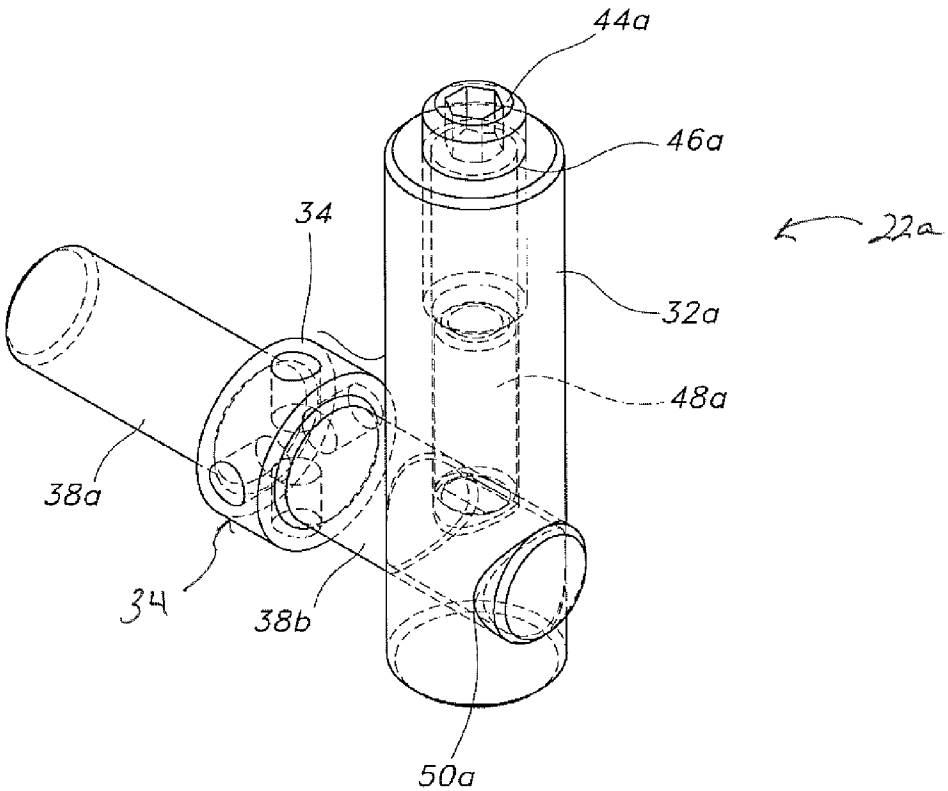
FIG. 8 shows the side cross-sectional view of FIG. 7, with the locking mechanism locked in place to prevent displacement of the side panels of an adjustable saddle tree.

As shown in FIG. 7, being a cross-sectional view of an adjusting cylinder 32*a*, adjusting cylinder 32*a* (and likewise adjusting cylinder 32*b*) defines a hollow interior having an interior surface 46*a* which is at least partially threaded. That interior threaded surface cooperatively receives a length of locking fastener 44*a* therein. Also provided is an insert 48*a* which is received within the interior of adjusting cylinder 32*a*. Shown also in the view of FIG. 7 is the first receiver 50*a* in cylinder 32*a* for receiving an end of the pins 38*a*, 38*b* of adjuster 34.

When assembled, insert 48*a* is captured between locking fastener 44*a* and threaded pin 38*a* (see FIG. 8) of the adjuster 34, whereby when locking fasteners 44*a* are advanced into the interior of the adjusting cylinders 32*a*, 32*b*, insert 48*a* impinges upon the pin 38*a* of the adjuster 34. In that manner, once the final user adjustments have been made to adjuster 34, and the locking fastener 44*a* is advanced into the interior of the adjusting cylinder 32*a* as described, the locking mechanism 22*a* is locked in place. Of course, corresponding features are found in the other locking mechanism 22*b*, which is secured in the identical manner described for locking mechanism 22*a*. Thus, opposed side plates 24*a*, 24*a*', 24*b*, 24*b*' cannot move relative to one another, and the width W of saddle tree 20 will remain substantially fixed until changed by the user.

Certain particularities of the device will now be described. Of course, a variety of conventional materials are known for fabricating a headplate such as is set forth herein. Typically, the present locking headplate 20 will be fabricated of a suitable metal material, such aluminum, steel, various alloys, and the like providing a desired combination of durability and light weight. Any suitable method of manufacture for these elements of the locking headplate 20 is contemplated, such as lost-wax casting and the like.

Desirably at least the threads of the threaded adjusting cylinders 32*a*, 32*b* will be fabricated of a suitably durable metal having a first hardness. The inserts 48*a*, 48*b* will be fabricated of a material having a second hardness that is less than that first hardness, that is, the hardness of the material of which the adjuster 34 and adjusting cylinders 32*a*, 32*b* are fabricated. Thus, as a non-limiting example, the adjuster 34 and adjusting cylinders 32*a*, 32*b* may be fabricated of case-hardened steel, whereas the inserts 48*a*, 48*b* are fabricated of aluminum, iron, or an alloy, with the caveat that the hardness of the material from which the inserts 48*a*, 48*b* are is fabricated is less than the hardness of the case-hardened steel from which the adjuster 34 and adjusting cylinders 32*a*, 32*b* are fabricated.

The skilled artisan will realize that this provides an additional securing mechanism, in that as the inserts 48*a*, 48*b* impinge upon the adjuster 34 threaded pins 38*a*, 38*b*, the relatively harder threads of the pins 38*a*, 38*b* will sink a short distance into the relatively softer material of the inserts 48*a*, 48*b*, thereby providing increased grip in comparison to a simple friction or interference fit. Of course, additional features may be provided on the surfaces of the inserts 48*a*, 48*b* that impinge on the pins 38*a*, 38*b*, such as a cross-hatching or threading pattern formed in the material of those surfaces to still further improve the gripping contact between the two.

In the depicted embodiment, the locking fasteners 44*a*, 44*b* are positioned in an end of adjusting cylinders 32*a*, 32*b*. However, the skilled artisan will appreciate that the specific positioning of locking fasteners 44*a*, 44*b* are a matter of design preference and user convenience. For example, the locking fasteners 44*a*, 44*b* may be positioned such that the user accesses them from a top of the saddle tree 20, from a bottom of the saddle tree 20, from the front of the saddle tree 20, or from the rear of the saddle tree 20. The sole requirement is that sufficient space be available to provide inserts 48*a*, 48*b* for capturing between locking screws 44*a*, 44*b* and the threaded pins 38*a*, 38*b* of adjuster 34.

Figure 9:
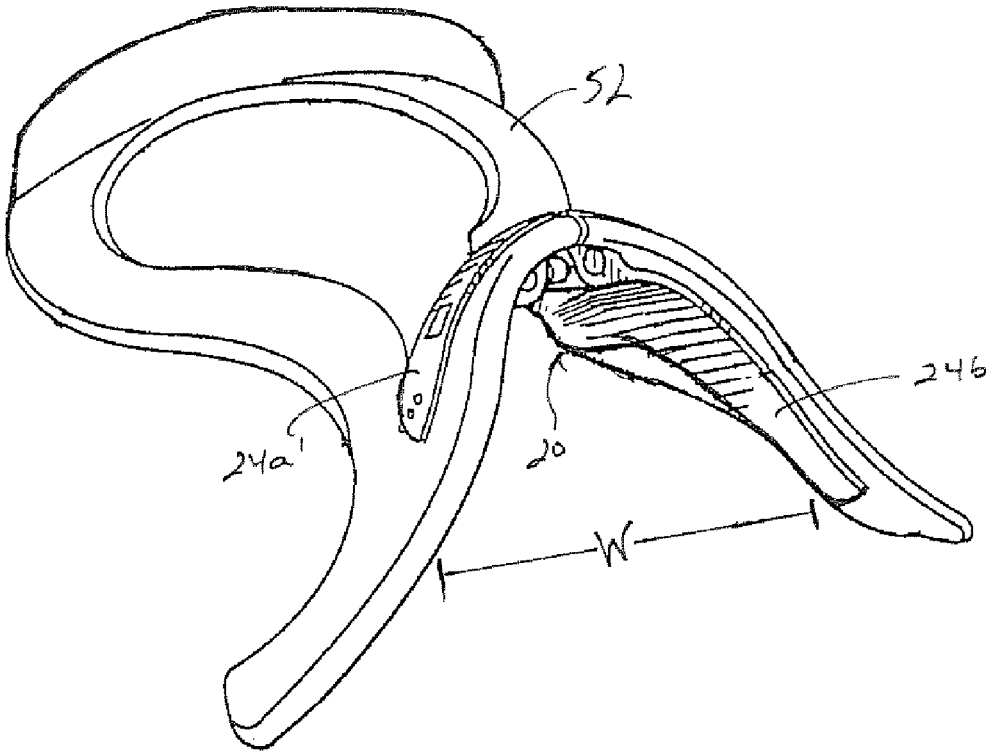
FIG. 9 shows the locking headplate assembly according to the present invention installed on a saddle tree.

The locking headplate 20 is contemplated for use with a saddle tree 52 such as is shown in FIG. 9. A saddle tree, as is known in the art, is simply a frame on which a combination of leather and padding is placed and secured to form the elements of a saddle (not shown), such as the cantle, seat, etc. The saddle tree 52 may be fabricated of any suitable material, such as wood, a durable polymer, or the like. Further, the saddle tree 52 may be divided or partially divided to allow greater flexibility. Alternatively, the saddle tree 52 may include a discrete head region fabricated of a sufficiently flexible material to allow the desired degree of flexibility imposed by the locking headplate 20. Still yet further, the saddle tree 52 may be fabricated in its entirety of a sufficiently flexible material to allow the desired degree of flexibility imposed by the locking headplate 20. In yet another embodiment, the saddle tree 52 may be hinged at the head portion to allow the desired degree of flexibility imposed by the locking headplate 20.

In use, the locking headplate 20 is secured to the head of a saddle tree 52 whereby opposed side plates 24*a*, 24*a*', 24*b*, 24*b*' capture the saddle tree head in the manner shown. Specifically, side plates 24*a*, 24*a*' receive one portion of the saddle tree 52 therein, and side plates 24*b*, 24*b*' receive a second portion of the saddle tree 52 therein in the manner shown. Any suitable fastener may be used to secure the locking headplate 20 to the saddle tree 52, including without limitation screws, rivets, bolts, and the like. The width W of the saddle tree 52 may then be adjusted in the manner described herein to accommodate a range of widths of the back areas of horses (not shown) on which the saddle is placed.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the foregoing description when interpreted in accordance with the breadth to which it is fairly, legally and equitably entitled.

What is claimed is:

1. A locking headplate for an adjustable saddle tree, comprising:

opposed, hingedly connected elements for securing to a saddle tree head portion;

a rotatable displacing element for displacing the hingedly connected elements inwardly or outwardly; and at least one engaging element for selectively preventing rotation of the rotatable displacing element, the at least one engaging element comprising a compression retainer for contacting the rotatable displacing element on a transverse axis, wherein said compression retainer comprises at least one insert and a threaded fastener for compressing the at least one insert against the rotatable displacing element to selectively prevent rotation thereof.

2. The locking headplate of claim 1, wherein the threaded fastener compresses the at least one insert against a screwthreaded pin of the rotatable displacing element to prevent rotation thereof.

3. The locking headplate of claim 2, wherein at least a screwthread of the screwthreaded pin of the rotatable displacing element is made of a material having a first hardness, and the at least one insert is made of a material having a second hardness which is less than the first hardness;

whereby when the threaded fastener compresses the at least one insert against the screwthreaded pin of the rotatable displacing element, a portion of the material of the screwthread of the screwthreaded pin impinges into the material of the insert.

4. The locking headplate of claim 1, wherein the hingedly connected elements each define at least one aperture through which an end of the rotatable displacing element passes, the hingedly connected element at least one aperture defining a cross-sectional dimension that is greater than a cross-sectional dimension of the rotatable displacing element end.

5. An adjustable saddle tree, comprising:

a body defining a saddle frame and including a head portion, first and second side portions, and a cantle portion; and a locking headplate for securing to the body head portion, the locking headplate comprising opposed, hingedly connected elements for securing to the body head portion, a rotatable displacing element for displacing the hingedly connected elements inwardly or outwardly, and at least one engaging element for selectively preventing rotation of the rotatable displacing element, the at least one engaging element comprising a compression retainer for contacting the rotatable displacing element on a transverse axis, wherein said compression retainer comprises at least one insert and a threaded fastener for compressing the at least one insert against the rotatable displacing element to selectively prevent rotation thereof;

wherein displacing the hingedly connected elements inwardly or outwardly correspondingly widens or narrows at least a portion of the saddle tree body.

6. The adjustable saddle tree of claim 5, wherein the threaded fastener compresses the at least one insert against a screwthreaded pin of the rotatable displacing element to prevent rotation thereof.

7. The adjustable saddle tree of claim 6, wherein at least a screwthread of the screwthreaded pin of the rotatable displacing element is made of a material having a first hardness, and the at least one insert is made of a material having a second hardness which is less than the first hardness;

whereby when the threaded fastener compresses the at least one insert against the screwthreaded pin of the rotatable displacing element, a portion of the material of the screwthread of the screwthreaded pin impinges into the material of the insert.

8. The adjustable saddle tree of claim 5, wherein the body is divided at least at the head portion to provide a desired degree of flexibility.

9. The adjustable saddle tree of claim 5, wherein at least the body head portion is fabricated of a suitably flexible material providing a desired degree of flexibility.

10. The adjustable saddle tree of claim 5, wherein at least the body head portion is hinged to provide a desired degree of flexibility.

11. The adjustable saddle tree of claim 5, wherein the hingedly connected elements each define at least one aperture through which an end of the rotatable displacing element passes, the hingedly connected element at least one aperture defining a cross-sectional dimension that is greater than a cross-sectional dimension of the rotatable displacing element end.

12. An adjustable saddle, comprising:

an adjustable saddle tree having a body defining a saddle frame and including a head portion, first and second side portions, and a cantle portion;

at least one layer of padding for improving comfort of the saddle;

a covering overlaying the adjustable saddle tree and the padding; and a locking headplate for securing to the body head portion, the locking headplate comprising opposed, hingedly connected elements for securing to the body head portion, a rotatable displacing element for displacing the hingedly connected elements inwardly or outwardly, and at least one engaging element for selectively preventing rotation of the rotatable displacing element, the at least one engaging element comprising a compression retainer for contacting the rotatable displacing element on a transverse axis, wherein said compression retainer comprises at least one insert and a threaded fastener for compressing the at least one insert against the rotatable displacing element to selectively prevent rotation thereof;

wherein displacing the hingedly connected elements inwardly or outwardly correspondingly widens or narrows at least a portion of the saddle tree body.

13. The adjustable saddle of claim 12, wherein the threaded fastener compresses the at least one insert against a screwthreaded pin of the rotatable displacing element to prevent rotation thereof.

14. The adjustable saddle of claim 13, wherein at least a screwthread of the screwthreaded pin of the rotatable displacing element is made of a material having a first hardness, and the at least one insert is made of a material having a second hardness which is less than the first hardness;

whereby when the threaded fastener compresses the at least one insert against the screwthreaded pin of the rotatable displacing element, a portion of the material of the screwthread of the screwthreaded pin impinges into the material of the insert.

15. The adjustable saddle of claim 12, wherein the body is divided at least at the head portion to provide a desired degree of flexibility.

16. The adjustable saddle of claim 12, wherein at least the body head portion is fabricated of a suitably flexible material providing a desired degree of flexibility.

17. The adjustable saddle of claim 12, wherein at least the body head portion is hinged to provide a desired degree of flexibility.

18. The adjustable saddle of claim 12, wherein the at least one layer of padding and the cover are fabricated of any suitable synthetic or natural material.

19. The adjustable saddle of claim 12, wherein the hingedly connected elements each define at least one aperture through which an end of the rotatable displacing element passes, the hingedly connected element at least one aperture defining a cross-sectional dimension that is greater than a cross-sectional dimension of the rotatable displacing element end.

* * * * *